United States Patent [19]

Wieck

[11] Patent Number: 4,573,289

[45] Date of Patent: Mar. 4, 1986

[54] APPARATUS FOR SUPERFINISHING BEARING ROLLERS

[75] Inventor: Karl Wieck, Stuttgart, Fed. Rep. of Germany

[73] Assignee: Supfina Maschinenfabrik Hentzen GmbH & Co KG, Fed. Rep. of Germany

[21] Appl. No.: 501,341

[22] Filed: Jun. 6, 1983

[30] Foreign Application Priority Data

Jul. 10, 1982 [DE] Fed. Rep. of Germany ..... 3225977

[51] Int. Cl.[4] ..... B24B 7/00; B24B 19/06

[52] U.S. Cl. ..... 51/57; 51/67

[58] Field of Search ..... 51/57, 67, 58

[56] References Cited

U.S. PATENT DOCUMENTS 2,283,792 5/1942 Cole ..... 51/67
3,156,073 11/1964 Strasbaugh ..... 51/57
4,004,375 1/1977 Wieck ..... 51/67
4,024,672 5/1977 Wieck ..... 51/57

FOREIGN PATENT DOCUMENTS 655306 7/1951 United Kingdom ..... 51/57

*Primary Examiner*—Harold D. Whitehead
*Attorney, Agent, or Firm*—Jones, Tullar & Cooper

[57] ABSTRACT

A method and an apparatus are described for superfinishing convex or concave jacket faces of rotationally symmetrical workpieces, in particular of roller bearing rollers, in which the workpiece is received and rotated between two rotatable rollers, at least one of which is driven, while a honing stone is lowered perpendicularly to the longitudinal axis of the workpiece against the jacket face and thereby executes an oscillation parallel to the longitudinal axis of the workpiece. Along at least a portion of its stroke movement, the honing stone is imparted a further oscillation, synchronous with the first, along a curved path located in the jacket face of the workpiece.

5 Claims, 7 Drawing Figures

APPARATUS FOR SUPERFINISHING BEARING ROLLERS

BACKGROUND OF THE INVENTION

1. Field of the Invention

The present invention relates to a method and an apparatus for superfinishing convex or concave jacket faces of rotationally symmetrical workpieces, in particular of roller bearing rollers. The workpiece is received and rotated between two rotatable rollers, at least one of which is driven, while a honing stone is lowered perpendicularly to the longitudinal axis of the workpiece against the jacket face and thereby executes an oscillation parallel to the longitudinal axis of the workpiece.

2. Prior Art

In this known method, the workpiece 3 is received, as shown in FIG. 1, between two rollers 1 and 2, which are rotating in the same rotational direction, and are coupled with them in the rotational direction as a result of friction. Because of a slightly oblique positioning of the rollers 1, 2 relative to one another, which is highly exaggerated in FIG. 1, a forward movement is simultaneously effected in the direction of the longitudinal axis of the workpiece. The workpiece 3 thereby travels through the apparatus underneath the honing stone 4, the honing stone 4 is lowered against the workpiece 3 in the direction indicated by the arrow shown above the honing stone holder 5 and pressed against the workpiece. As the workpiece 3 rotates, the honing stone 4, driven by a mechanism which is not shown, executes an oscillation having a frequency of 1500 Hz, for example, in the direction of the longitudinal axis of the workpiece 3. This machining operation on the jacket face of the workpiece, which is also known as superhoning, exterior fine honing or superfinishing, produces an extraordinarily smooth and dense surface; at the same time, errors in concentricity of the workpiece are compensated for.

A workpiece shape such as that shown in FIG. 2 is frequently desirable. This shape is found in roller bearing rollers the jacket faces of which are cylindrical in the middle, in the zone marked Z, and then rounded (that is, convex) in the adjoining zones B, where the radius of curvature decreases in length from a value of $R_{max}$ adjoining zone Z to a value of $R_{min}$ at the end. With such shapes it is possible to avoid peaks in mechanical strain which would otherwise occur at the ends and which cause great and irregular strains and wear in roller bearing operation, especially if the roller bearing rollers are installed in even a slightly crossed position. The ideal shape of the workpiece 3 of FIG. 2 has a continuous transition between zone Z and zone B; that is, the cylindrical jacket line in zone Z is a tangent to the adjacent rounded or convexly curved zone B. Furthermore, the radius of curvature of the rounded or convex part B should become steadily smaller (that is, the curvature should be increased) toward the end of the roller bearing rollers, until at the end of the roller bearing roller the curvature is at its greatest. The shape of the rounded part or convex zone B is accordingly parabolic.

Thus far it has not been possible to meet these demands with a method or an apparatus according to FIG. 1. It was only possible to fabricate roller bearing rollers such as that shown in principle in FIG. 3, that is, having a single radius of curvature—rather than a radius of curvature which decreases steadily toward the outer end—and with a discontinuous or abruptly angled transition between the cylindrical zone Z and the rounded zone B. This was the result of the only manner in which it was possible to fabricate these kind of jacket faces in roller bearing rollers. That is, with an apparatus such as that shown in FIG. 1, the rollers 1 and 2 are not ground precisely cylindrically, but rather such that the outer contour is given practically a "hill", that is, an elevation, such as that shown in FIG. 4 and marked 2'. Since, as has already been noted, an advancing movement is imparted to the roller bearing roller in the direction of its longitudinal axis as a result of the oblique positioning of the rollers 1, 2 relative to one another, the roller travels over this elevated contour 2' as well, and the result, in sequence, are the various positions 3-1, 3-3, producing a circularly rounded shape at the ends as a result of the machining performed with the honing stone 4. However, this operation produces only a single, definite radius of curvature and a discontinuous transition from Z to B.

A further disadvantage of the known method (FIGS. 1, 3, 4) is that only radii of curvature up to a certain limit can be attained. If smaller radii of curvature are desired, then the elevated contour 2' would have to be so pronounced that there would no longer be any force component in the advancement direction. Thus the continuous-travel method described above fails completely.

A further and particularly grave disadvantage of the known method is that it is extraordinarily difficult to fabricate rollers having contours such as are shown in FIG. 4. First they must be calculated in an extremely complicated manner, and then they must be ground in an operation of great difficulty.

OBJECT AND SUMMARY OF THE INVENTION

It is accordingly a principal object of the present invention to provide an apparatus in which workpieces such as those shown in FIG. 2, that is, having a cylindrical middle zone Z and a rounded zone B adjoining it in which the radius of curvature decreases toward the ends, can be produced.

Stated in general terms, the object is to embody an apparatus such that any arbitrary convex or concave jacket faces having a varying curvature can be produced on rotationally symmetrical workpieces (for instance, on roller bearing rollers).

This object is attained in that a further oscillation, synchronous with the first oscillation, along a curved path is imparted to the honing stone, at least along a portion of its reciprocating movement, the curved path being located in the jacket face of the workpiece.

A further development of the device then provides that the radius of curvature of the curved path is varied during the course of one finishing cycle for one workpiece.

An apparatus for performing this operation is characterized in that the honing stone is disposed on a first plate, which is pivotable on a second plate, and the second plate is displaceable relative to the machine frame parallel to the longitudinal axis of the workpiece. Drive mechanisms are provided which impart to the first plate a rotary oscillation relative to the second plate and impart to the second plate a linear oscillation parallel to the longitudinal axis of the workpiece.

In terms of the apparatus for attaining the stated object, the operation according to the present invention can be briefly summarized in that the normal oscillation of the honing stone, which is part of the known superfinishing operation, has superimposed upon it a further oscillation movement along a circular path, and the position of the center of this circular path, and then the radius of it, are varied during the course of one workpiece finishing cycle. Thus the desired shape of the workpiece as shown in FIG. 2 is created.

In structural terms, it is provided that the honing stone is associated with a plate which executes a rotary oscillation. The pivot point is for its part displaceable as well and it executes an oscillation parallel to the longitudinal axis of the workpiece. The desired movement of the honing stone back-and-forth along a circular path is the product of the superimposition or addition of these two oscillations. The radius of curvature is determined by means of varying the amplitudes of these oscillations.

One exemplary embodiment of the present invention and its advantageous further developments will be described in greater detail below, referring to the drawings.

DESCRIPTION OF THE PREFERRED EMBODIMENT

Figure 1:
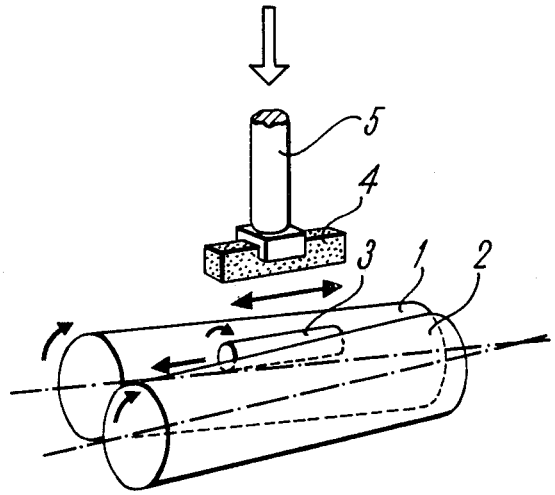
FIG. 1 is a schematic illustration of the production of roller bearing rollers according to the prior art.
Figure 5:
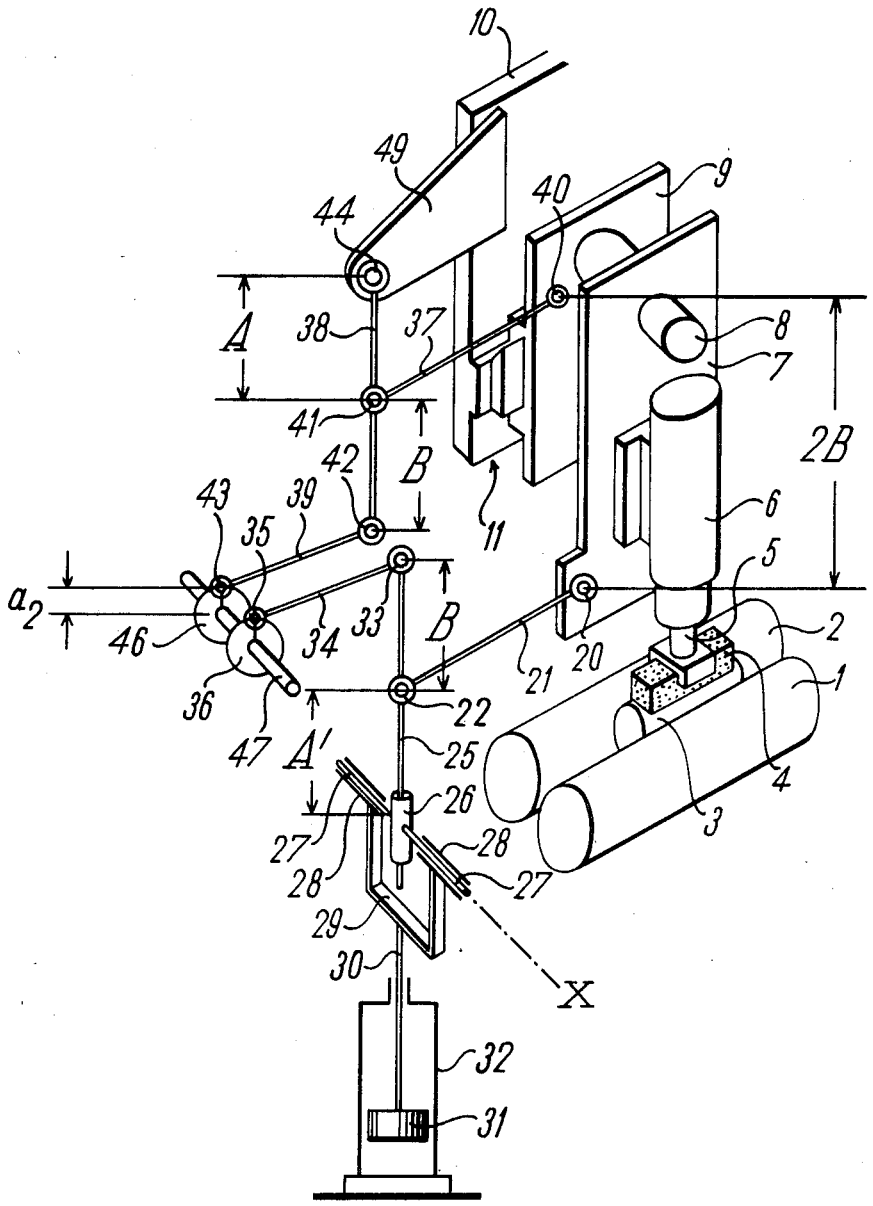
FIG. 5 shows an exemplary embodiment of the present invention.

In FIG. 5, the workpiece 3 is received between two cylindrically embodied rollers 1 and 2, which are disposed parallel to one another. The two rollers 1 and 2 rotate in the same direction and thus cause the workpiece 3 to rotate as well. Seated on the workpiece 3 is the honing stone 4, which is held by a honing stone holder 5. The honing stone holder 5 is disposed in a cylinder 6 and is pressed pneumatically or hydraulically against the workpiece 3. The cylinder 6 is mounted on a plate 7. The apparatus thus does not operate according to the continuous-travel process, as shown in FIG. 1, but rather according to the interrupted-travel or pass process.

The plate 7 is pivotable about a shaft 8, which is firmly disposed on a plate 9. The plate 9 is displaceable on the machine frame, which in FIG. 5 is represented by the plate 10, parallel to the longitudinal axis of the workpiece 3 with the aid of a sled guide 11.

The following movements are now generated in synchronism with one another:

(a) a rotary oscillation (a back-and-forth pivoting motion) of the plate 7 about the shaft 8; and (b) a linear oscillation (back-and-forth motion) of the plate 9 along the sled guide 11.

A connecting rod (transmission element) 21 is articulated on the plate 7 with a connecting rod bearing 20. This connecting rod 21 is articulated with a further connecting rod bearing 22 on a rod 25. The rod 25 is displaceably disposed in a bushing sleeve 26. The bushing sleeve 26 is provided with journals 27 at either side, which are rotatably supported in bearings 28, which are supported in turn by a U-shaped frame part 29. The frame part 29 is firmly connected to a rod 30. The rod 30 is connected with a piston 31, which is pneumatically or hydraulically displaceable in a cylinder 32. Upon the displacement of the piston 31 in the cylinder 32, the distance between the axis of rotation X of the journals 27 and the connecting rod bearing 22, which represents the point of engagement of the connecting rod 21 on the rod 25, is accordingly displaced as well. This distance is designated as A'.

The rod is furthermore connected via a further connecting rod bearing 33 with a further connecting rod 34, which is in turn eccentrically disposed via a connecting rod bearing 35 on a drive disk 36. The distance between the connecting rod bearing 22 and the connecting rod bearing 33 is designated as B.

Figure 6:
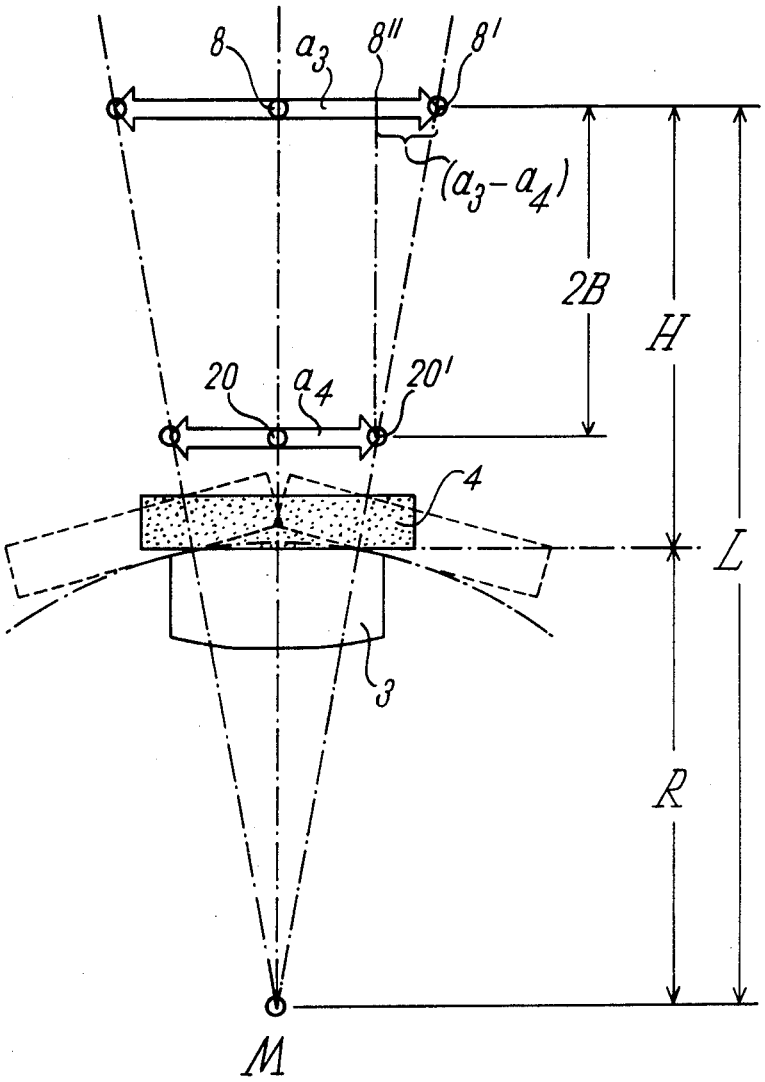
FIG. 6 is a diagram showing the geometrical relationships in the exemplary embodiment according to FIG. 5.

A rotation of the drive disk 36 thus effects a pivoting back-and-forth, that is, a rotary oscillation of the rod 25 about the axis of rotation X. This rotary oscillation is transmitted by the connecting rod 21 to the plate 7, which correspondingly executes a rotary oscillation about the shaft 8. The stroke of this rotary oscillation of the plate 7 depends here on the distance A'. The stroke with which the plate 7 swings back-and-forth is designated $a_4$ (FIG. 6).

The back-and-forth motion of the plate 9 relative to the plate 10 in a stationary manner is effected by means of a connecting rod 37 (transmission element), a rod 38 and a connecting rod 39. The connecting rod 37 is articulated on the plate 9 with the connecting rod bearing 40 and on the rod 38 with the connecting rod bearing 41.

The rod 38 is connected with the connecting rod 39 via a connecting rod bearing 42. The connecting rod 39 is articulated eccentrically on the drive disk 46 with a connecting rod bearing 43. The drive of the disk 46 is effected in synchronism with that of the drive disk 36. This is effected in a simple manner in that both disks are disposed firmly on a common shaft 47, which is driven by a drive mechanism not shown. The distance between the connecting rod bearings 35, 43 and the axis of rotation of the shaft 47 is marked $a_2$. This distance determines the stroke of the connecting rods 39, 34 upon the rotation of the drive disks 36, 46.

The rod 38 is disposed via a further connecting rod bearing 44 on a bracket 49 on the plate 10. The bracket 49 is disposed in a stationary manner on the plate 10, and is thus disposed in a stationary manner on the machine frame as well. The distance between the connecting rod bearings 41 and 44 is marked A; the distance between the connecting rod bearings 41 and 42 is marked B, which is the same distance between the connecting rod bearings 33 and 22, likewise marked B. Because of this drive, the plate 9 executes a back-and-forth motion along the sled guide 11 relative to the plate 10, the stroke of which is marked $a_3$ (FIG. 6).

If the shaft 47 is now driven, then the result is the two oscillations discussed above.

The connecting rod bearing 33 is located at the same level as the connecting rod bearing 42 (this is not immediately apparent in FIG. 5 because of the perspective of the sketch). Then the distance between the shaft 8 and the connecting rod bearing 20 is equal to 2B.

The geometric relationships which can indicate the movements of the honing stone 4 and its radius of curvature R are shown in FIG. 6.

In FIG. 6, the position of the shaft 8 as well as of the connecting rod bearing 20 is observed during the course of one stroke in both extreme positions as well as in the middle position. (In order to simplify FIG. 6, it is presumed that the connecting rod bearing 20 is located in a vertical line through the shaft 8.)

The positions shown are the middle position and the extreme positions with a maximum amplitude at the left and at the right. The distance between the honing stone 4 (that is, the underside) and the shaft 8 is H. The radius of the circular movement which the honing stone 4 executes is R. The distance between the center point M about which the honing stone 4 executes a circular movement and shaft 8 is equal to L. Then, $$R=L-H. \tag{1}$$

The stroke $a_3$ during the back-and-forth motion (linear oscillation) of the plate 9 and thus also the stroke of the back-and-forth motion of the shaft 8 is the result of the geometry of the drive system, embodied by the drive disk 46 and the connecting rods 38, 39, as follows:

$$a_3 = a_2 \cdot \frac{A}{(A+B)} \tag{2}$$

The stroke of the connecting rod bearing 20 or of the plate 7 during the pivoting motion (rotary oscillation) about the shaft 8 is determined in a corresponding manner, as follows:

$$a_4 = a_2 \cdot \frac{A}{(A'+B)} \tag{3}$$

Since the triangles (M, 8, 8') and (20', 8'', 8') are similar and the distance from 8' to 8'' is equal to ($a_3$-$a_4$), the distance L may be indicated as follows:

$$L = a_3 \cdot \frac{2B}{(a_3 - a_4)} \tag{4}$$

If equation (1) is taken into consideration, then the radius of curvature of the circular path along which the honing stone 4 moves is then determined as follows:

$$R = a_3 \cdot \frac{2B}{(a_3 - a_4)} - H \tag{5}$$

This radius can be varied continuously by displacing the piston 31, because of course with the displacement of the piston 31, a variation in the distance A' is effected. However, the stroke $a_4$ varies with A' in accordance with equation (3), and thus the radius of curvature R varies with A' as well.

This will now be expressed, by way of example, using numerical values. Let it be assumed that A=B=75 mm; $a_2$=4 mm; $a_3$=2 mm.

A' should amount at first to 40 mm, and during the finishing operation it is to be increased to A=75 mm; this is effected by means of the movement of the piston 31 downward in the cylinder 32. The result is the following values for the amplitude $a_4$ and the radius R:

| A' (mm) | $a_4$ (mm) | R (mm) |
|---|---|---|
| 40 | 1.143 | 493 |
| 50 | 1.40 | 750 |
| 60 | 1.60 | 1364 |
| 70 | 1.93 | 4348 |
| 73 | 1.97 | 11100 |
| 75 | 2.0 | ∞ |

Figure 7:
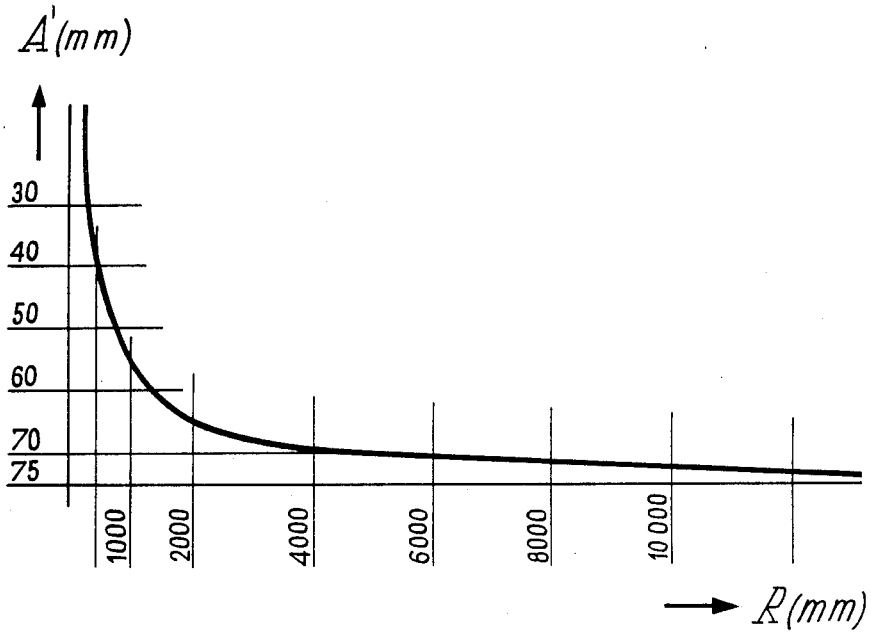
FIG. 7 shows the dependency of the radius of curvature R on the distance A'.

The result of this calculation is shown in FIG. 7. At the beginning, a relatively great variation in the distance A' produces only a relatively small variation in the radius R; for instance, a change in A' from 40 to 50 mm results in an enlargement of the radius R from 493 to 750 mm. In contrast, then, with a larger distance A', a relatively small variation in A' produces a very pronounced change in the radius R. If A'=A, and the amplitudes of both oscillations are the same, then the radius of curvature is infinite; that is, the honing stone moves on a cylindrical jacket face of the workpiece.

Figure 2:
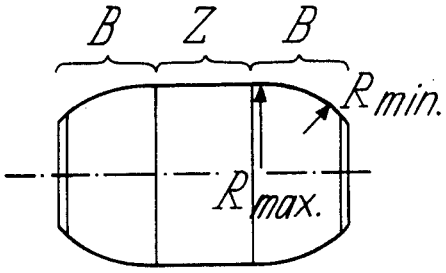
FIG. 2 shows the desired shape of roller bearing rollers, such as is intended to be attainable in accordance with the present invention.
Figure 3:
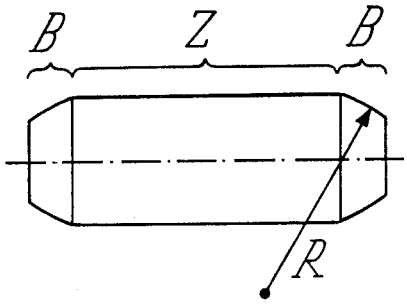
FIG. 3 shows the shape of roller bearing rollers when produced in accordance with FIG. 1.
Figure 4:
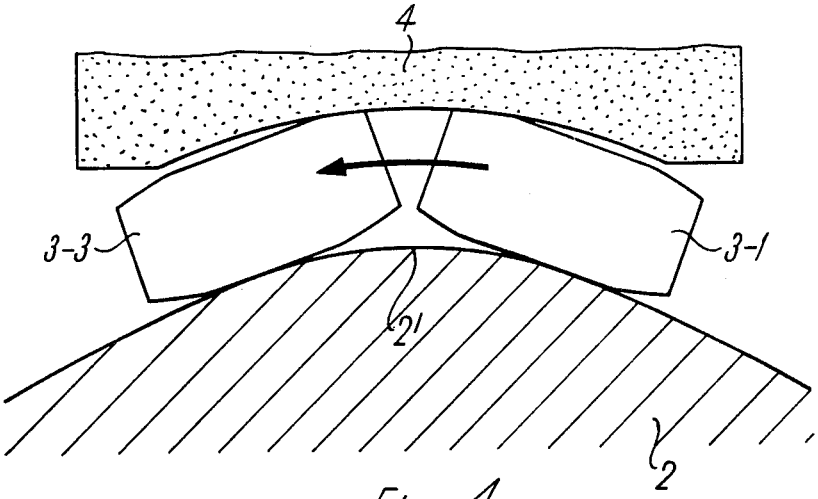
FIG. 4 is an illustration explaining the production of roller bearing rollers according to the prior art (FIGS. 1, 3)

Given a uniform speed in the motion of the piston 31, FIG. 7 means that the radius R varies only slowly at first, yet toward the end of the movement varies quite rapidly. This corresponds to the large amount of material necessarily removed from the end of the workpiece when the radius is small, for which removal a longer time period is then available. As the curvature decreases, the amount of material removed becomes less. This also corresponds precisely to the desired shape shown in FIG. 2.

In the apparatus according to FIG. 5, the rollers 1, 2 are cylindrical and disposed parallel to one another, as already mentioned. Accordingly, no advancing movement in the direction of its longitudinal axis is imparted by the rollers to the workpiece 3. Instead, finishing is performed by the interrupted-travel method. That is, with the disposition of two rollers as in FIG. 5, the workpiece 3 must be separately put into place, then the honing stone must be lowered and a finishing cycle performed. It is also possible, however, to provide that a plurality of honing stations, such as shown in FIG. 5, be disposed one after the other, and that two rollers at a time, between and on which one workpiece is placed, travel in increments through one station after the other; the finishing operation in the individual stations may be graduated depending upon the grain of the honing stone or the like.

In principle, any sort of rounded finishing operation can be performed with the apparatus shown; it is readily apparent from FIG. 6 that for $a_4$=o, a convex surface B is obtained without any cylindrical intermediate part Z. In the same manner, concave surfaces can be machined. All that is necessary is that appropriate structural provisions be made so that $a_4$ is greater than $a_3$. In that case, the shape of the honing stone 4 then adapts automatically, because of the corresponding wear, to the concave surface created as a result of the finishing, the radius of curvature of which is predetermined by the parameters as they have been set.

To summarize in general terms: For the desired finishing operation, the back-and-forth movement of the honing stone, which is known (FIG. 1), must have superimposed upon it a movement along a circular path. This is realized in FIG. 5 in that the plate 7 carrying the honing stone is moved back-and-forth, and that the plate 9 is disposed on the plate 7, being likewise moved back-and-forth, in fact in a linear manner. Now if the plate 7 is practically prevented from following the plate 9, by means of a synchronous pivoting movement having a shorter stroke, then the result is the tilting movement at the ends of the workpieces as shown in FIG. 6.

FIG. 5 illustrates only one—albeit a preferred one—of the possible exemplary embodiments with which it is possible to produce these movement profiles. In principle, any opportunities, whether mechanical or otherwise (hydraulic, pneumatic, electrical), may be utilized in order to produce these movements. There is absolutely no restriction requiring the selection of the described disposition of connecting rods. The adjustability of the stroke $a_4$ is effected in the present exemplary embodiment by means of varying the distance between the axis of rotation X and the connecting rod bearing 22. However, the stroke can also be varied by varying the eccentricity of the connecting rod bearing 47 on the drive disk 36. It would be equally possible to keep the stroke $a_4$ at a fixed value and to make the stroke $a_3$ adjustable, by any means with which the distance A can be adjusted.

What is claimed is:

1. An apparatus for superfinishing a cylindrical workpiece, the cylindrical surface of which is rotationally symmetrical and convex defining thereby a cylindrical axis, said apparatus comprising:

a machine frame;

two rotatable rollers for imparting rotation to the workpiece about its cylindrical axis;

an oscillating honing stone;

a first plate to which the oscillating honing stone is mounted;

a second plate to which the first plate is pivotably mounted; and first drive means and second drive means connected to the first plate and the second plate, respectively, and rotatable with respect to a common axis to impart a synchronous oscillatory motion to the first plate and the second plate, respectively, and to thereby superimpose on the oscillating honing stone a further oscillatory motion along a circular path.

2. The apparatus as defined in claim 1, further comprising:

adjustment means for continuously varying the amplitude of at least one of the two oscillations during the course of a finishing cycle intended for one workpiece.

3. The apparatus as defined in claim 4, wherein each drive means comprises:

a pair of rods each associated with one of said plates, each rod being rotatably supported at one end;

a pair of drive disks, each associated with one of said pair of rods;

a pair of connecting rods, each being eccentrically mounted at one end to a respective one of said drive disks, and connected at their other end to a respective one of said pair of rods at the other ends of said rods; and a pair of transmission elements, each being connected at one end to a respective one of said plates and at their other end to a respective one of said rods, said oscillations being transmitted to said plates by said transmission elements.

4. The apparatus as defined in claim 3, further comprising:

means defining an axis of rotation for one of said transmission elements, and wherein the radius of curvature of said circular path is varied by varying the distance defined between the intersection of said one of said transmission elements and its respective rod and said axis of rotation.

5. The apparatus as defined in claim 4, wherein the means defining an axis of rotation includes a rotatably disposed bushing sleeve within which the rod connected to said one of said transmission elements is longitudinally displaceable, and a piston/cylinder apparatus connected to the bushing sleeve for displacing the bushing sleeve and thereby the axis of rotation.

* * * * *

UNITED STATES PATENT AND TRADEMARK OFFICE

CERTIFICATE OF CORRECTION

PATENT NO. : 4,573,289

DATED : March 4, 1986

INVENTOR(S) : Wieck

It is certified that error appears in the above-identified patent and that said Letters Patent is hereby corrected as shown below:

Claim 3, line 1, "claim 4" should be --claim 2--.

Signed and Sealed this

Thirteenth Day of January, 1987

*Attest:*

DONALD J. QUIGG

*Attesting Officer*

*Commissioner of Patents and Trademarks*